US006568657B2

(12) United States Patent
Muir

(10) Patent No.: US 6,568,657 B2
(45) Date of Patent: May 27, 2003

(54) SUPPORT MEANS

(76) Inventor: Anthony Robert Muir, 36 Downing Street, Ngaio, Wellington (NZ)

( * ) Notice: Subject to any disclaimer, the term of this patent is extended or adjusted under 35 U.S.C. 154(b) by 157 days.

(21) Appl. No.: 09/788,527

(22) Filed: Feb. 20, 2001

(65) Prior Publication Data

US 2002/0024044 A1 Feb. 28, 2002

(30) Foreign Application Priority Data

Aug. 31, 2000 (NZ) ..... 506705

(51) Int. Cl.[7] ..... E04H 17/14
(52) U.S. Cl. ..... 256/65.06
(58) Field of Search ..... 256/65.01, 65.02, 256/27, 56, 59, 66, 73, 67, 1, 19, 65.03–65.16

(56) References Cited

U.S. PATENT DOCUMENTS 3,894,375 A * 7/1975 Lindberg, Jr. ..... 52/298
4,002,322 A * 1/1977 Matsubara ..... 256/65.06
4,346,872 A * 8/1982 Tornya ..... 256/65.02
4,359,851 A 11/1982 Daniels
4,787,601 A * 11/1988 Rybak ..... 256/19
4,892,292 A * 1/1990 Russell ..... 256/19
5,040,251 A * 8/1991 Hanford ..... 4/496
5,165,663 A * 11/1992 Wells ..... 256/1
5,547,169 A * 8/1996 Russell ..... 256/59
5,957,437 A * 9/1999 Savenok ..... 256/59
5,967,498 A * 10/1999 Junell ..... 256/19

* cited by examiner

*Primary Examiner*—Robert E. Pezzuto
(74) *Attorney, Agent, or Firm*—O. M. Zaghmout

(57) ABSTRACT

A hand rail support 1, having a substantially cylindrical shaped containment portion 2, a face plate 3, and a flange 4. The face plate 3 and the flange 4 facilitate securing the hand rail support 1 to a building construction. The containment portion 2 can receive a baluster of a hand rail together with a settable substance, for example a suitable grout, so that the baluster is securely held in the containment portion.

20 Claims, 2 Drawing Sheets

SUPPORT MEANS

FIELD OF INVENTION

This invention relates to support means. In particular, a preferred form of the invention relates to support means for a hand rail.

BACKGROUND ART

In the building industry it is well known to fasten hand rails to a building construction to provide a safe and aesthetically pleasing finish to the construction. Such hand rails may incorporate a series of brackets which are fixed to wooden framing or the like by way of screws or some other suitable fixing means. A problem faced in the use of hand rails is that the points where they are fixed to the wooden framing may become positions of ingress to moisture. Such ingress of moisture very often causes the timber framing to rot, and thus to weaken. Wooden framing which has been left to rot for some time can present a significant hazard, and can require substantial expense to rectify. Moreover, it is often not possible to detect the rotting framing as there are no visible signs of this on the exterior of the construction. It is accordingly an object of at least one aspect of the present invention to go at least some way towards addressing the above problem.

In interpreting this specification, including the associated claims, the term "comprising" or "comprises" or "comprise", if and where appearing, should be taken to be non-exclusive—ie should be taken to mean "consisting of or including".

GENERAL DESCRIPTION OF INVENTION

According to one aspect of the invention there is provided, in combination, a building construction, a hand rail support secured to the building construction, and a hand rail, the hand rail having at least one baluster and a balustrade, the hand rail support having a containment portion, the containment portion having an opening through which at least part of the baluster passes such that at least a portion of the baluster is secured within the containment portion by a set settable substance, the set settable substance being arranged within the containment portion substantially around at least part of the baluster, the hand rail support being arranged such that water is unable to pass immediately around the hand rail support to an area within the building construction to cause damage to the building construction.

Preferably the containment portion is substantially cylindrical in shape, and may be substantially square, substantially rectangular, or substantially circular, in transverse cross section.

Preferably there is a layer of water impervious material extending from the building construction to the hand rail support, the water impervious material serving to prevent water from passing around the hand rail support to an area within the building construction. The water impervious material may be in the form of a sheet.

Preferably the setable substance is a suitable grout.

Preferably the hand rail support has a face plate which lays against the building construction.

Optionally the opening is substantially flush with an exterior facing surface of the building construction. In this arrangement the containment portion may be substantially within a cavity forming part of the building construction.

Optionally the containment portion extends outwards from adjacent the building construction such that the opening is spaced from the building construction.

Preferably the containment portion is substantially square, substantially rectangular, or substantially circular, in transverse cross section.

According to another aspect of the invention there is provided a hand rail support, having a substantially cylindrical containment portion, an opening in the containment portion for receiving a hand rail baluster, a face plate extending substantially around the opening, and a flange extending from the containment portion, the flange being substantially perpendicular with respect to the face plate. Preferably the face plate and the flange each have an aperture or apertures for receiving fixing members. Preferably the face plate extends substantially around and is substantially flush with the opening.

According to another aspect of the invention there is provided a hand rail support, having a pillar, a face plate attached to the pillar, and a flange extending from the face plate, the flange being substantially perpendicular with respect to the pillar. The pillar may be substantially solid, or alternatively may be substantially hollow with an opening leading into the pillar. Preferably the face plate and the flange each have an aperture or apertures for receiving fixing members. Preferably the face plate is adjacent an end of the pillar which is remote from the opening.

BRIEF DESCRIPTION OF THE DRAWINGS

Some preferred aspects of the invention will now be described by way of example, and with reference to the accompanying drawings, of which.

DETAILED DESCRIPTION OF THE INVENTION

Figure 2:
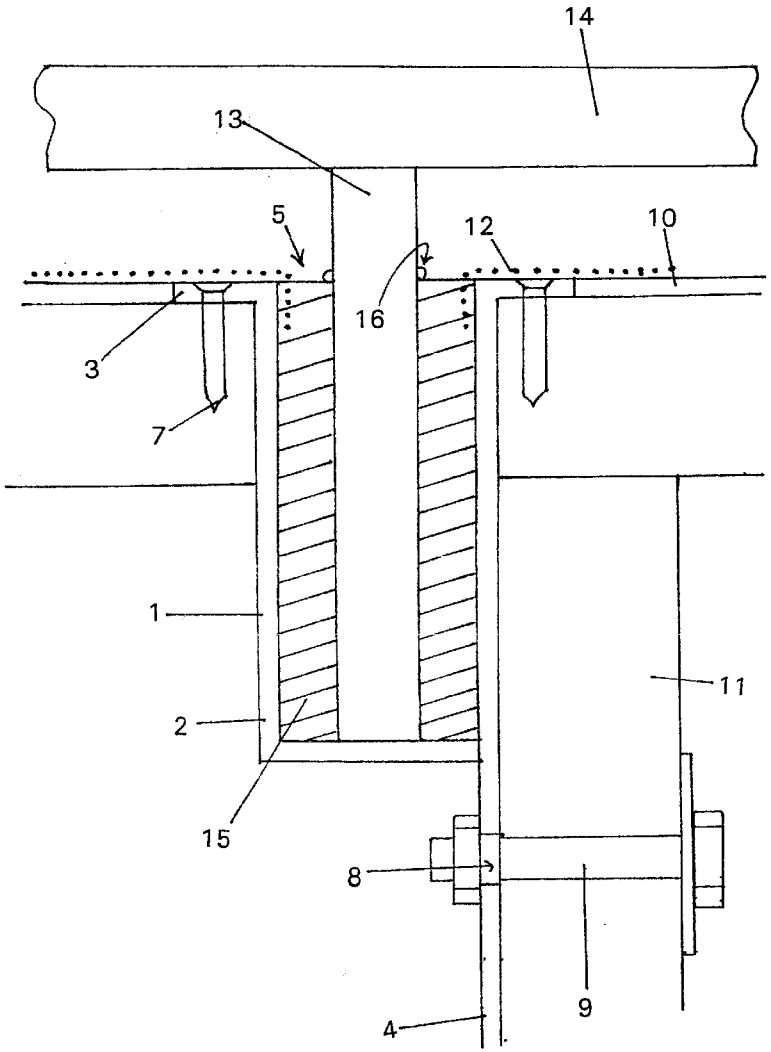
FIG. 2 is a cross-sectional view showing the hand rail support in use.
Figure 1:
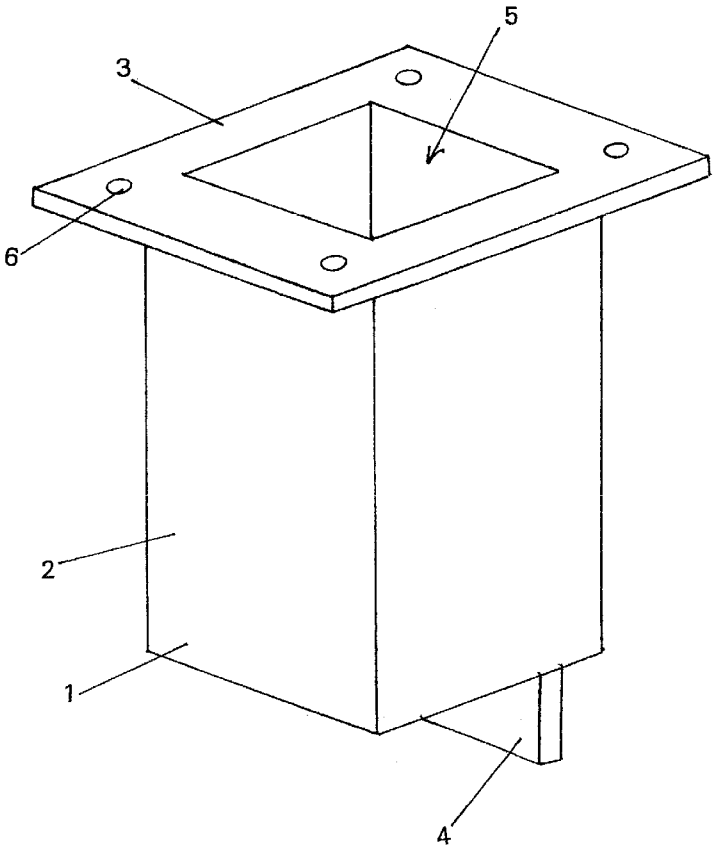
FIG. 1 is perspective view of a hand rail support.

With reference to figures 1 and 2, a hand rail support 1 comprises a containment portion 2, a face plate 3, and a flange 4. The containment portion 2 is cylindrical in shape with an opening 5. As shown, the containment portion is substantially square in transverse cross section—ie when the section taken runs parallel to the face plate 3. The face plate 3 has apertures 6 for receiving screws 7 or other suitable fixing members. The flange 4 is substantially planar and also has an aperture 8 for receiving a bolt 9 or some other suitable fixing member. The hand rail support 1 is preferably formed from a rigid non-corrosive metallic material, for example galvanised steel.

With particular reference to FIG. 2, when the hand rail support 1 is in use it is arranged with the containment portion 2 extending into a building construction such that the face plate 3 is substantially flush with an exterior facing surface 10 of the building construction (ie a surface which faces outwards). This can be facilitated by counter-sinking the face plate 3 with respect to the exterior facing surface 10. However, for the purpose of this document the face plate 3 should also be taken as being flush with the exterior facing surface 10 when it is laying against the exterior facing surface 10 without the counter-sinking. The exterior facing surface 10 may be an upper part of a barrier extending around an elevated balcony or deck area of the building construction. The hand rail support 1 may be secured to wooden framing 11 forming part of the barrier by way of the flange 4 and bolt 9.

To prevent rain water passing around the hand rail support 1 to the internal framing or other parts of the building construction a water guard 12 is employed. The water guard 12 may be in the form of a water impervious sheet adhered to the exterior facing surface 10 and the hand rail support 1. As shown in FIG. 2, the water guard 12 passes over the face plate 3 and into the containment portion 2.

A hand rail can be fitted to the building construction by way of the hand rail support 1. The hand rail is of a kind having a baluster 13 and a balustrade 14. The baluster 13 is positioned within the containment portion 2 of the hand rail support 1. A cementitious substance, for example a suitable grout 15, is filled within the containment portion 2 around the baluster 13 to secure the baluster 13 in place. Other hand rail supports 1 may be arranged in similar fashion with other balusters such that the balustrade 14 is spaced from and runs parallel to the exterior facing surface 10.

A silicon sealant 16 is preferably applied around the baluster 13 where the baluster 13 contacts the grout 15. Additionally, a suitable decorative coating may be applied over the exterior facing surface 10, over the face plate 3, and over the grout.

Figure 4:
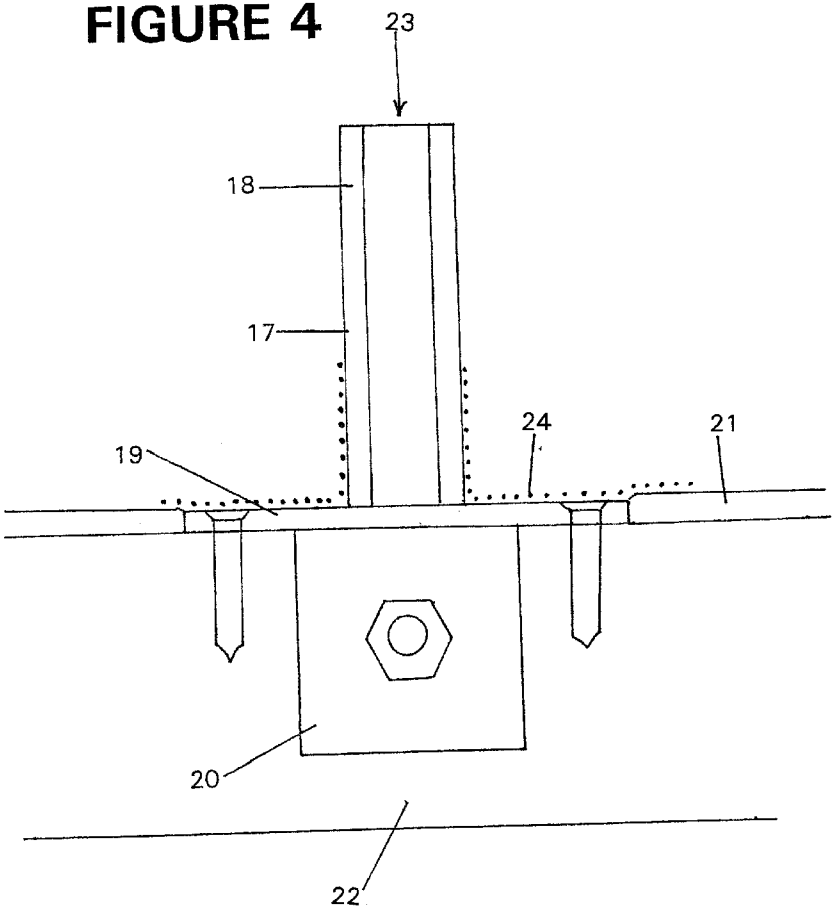
FIG. 4 is a cross sectional view showing the alternative hand rail support in use.
Figure 3:
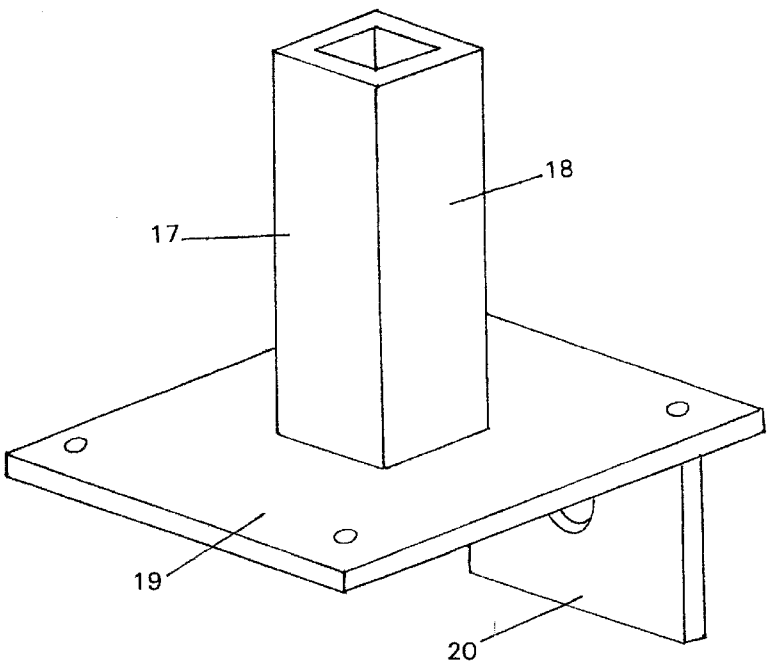
FIG. 3 is an alternative hand rail support.

With reference to FIGS. 3 and 4, an alternative hand rail support 17 comprises a hollow pillar 18 extending outwards from a face plate 19. A flange 20 extends perpendicularly from the face plate 19. The face plate 19 and the flange 20 each have an aperture or apertures for receiving screws, bolts, or similar. When the alternative hand rail support 17 is in use the face plate 19 is screwed on to an outward facing surface 21 similar to the outward facing surface 10 described above, and the flange 20 is bolted to internal framing 22. The pillar 18 has one opening 23, and that opening faces outwards with respect to the outward facing surface 21 to receive a baluster (not shown) forming part of a hand rail, and also to receive grout. A suitable water stop 24, eg a flexible impervious adhesive sheet, is applied over the exterior facing surface 21, over the face plate 19, and extends against the exterior of the pillar 18, to prevent water from passing around the alternative hand rail support 17 to damage the internal framing 22. Preferably the hand rail support 17 is formed from a suitable non-corrosive metallic material.

In some alternative embodiments of the invention a hollow baluster may be fitted around the pillar 18 of the alternative hand rail support 17—ie the baluster fits around the pillar 18 as per a sleeve rather than fitting within the pillar. In this embodiment there is no need for grout or similar, although the water stop 24 is still utalised—ie the water stop extends from the exterior facing surface 21 to between the exterior of the pillar 18 and the interior of the baluster. In such embodiments the pillar need not be hollow.

While some preferred forms of the invention have been described by way of example it should be appreciated that improvements and modifications can occur without departing from the scope of the appended claims.

What is claimed is:

1. In combination, a building construction, a hand rail support secured to the building construction, and a hand rail, the hand rail having at least one baluster and a balustrade, the hand rail support having a containment portion, the containment portion having an opening through which at least part of the baluster passes such that at least a portion of the baluster is secured within the containment portion by a set settable substance, the set settable substance being arranged within the containment portion substantially around at least part of the baluster, the hand rail support being arranged such that water is unable to pass immediately around the hand rail support to an area within the building construction to cause damage to the building construction.

2. A combination according to claim 1, wherein the containment portion is substantially cylindrical in shape.

3. A combination according to claim 1, wherein there is a layer of water impervious material extending from the building construction to the hand rail support, the water impervious material serving to prevent water from passing around the hand rail support to an area within the building construction.

4. A combination according to claim 1, wherein there is a layer of water impervious material extending from the building construction to the hand rail support, the water impervious material serving to prevent water from passing around the hand rail support to an area within the building construction, the water impervious material being in the form of a sheet.

5. A combination according to claim 1, wherein the setable substance is a suitable grout.

6. A combination according to claim 1, wherein the hand rail support has a face plate which lays against the building construction.

7. A combination according to claim 1, wherein the opening is substantially flush with an exterior facing surface of the building construction.

8. A combination according to claim 1, wherein the containment portion extends outwards from adjacent the building construction such that the opening is spaced from the building construction.

9. A combination according to claim 1, wherein the containment portion is substantially square, substantially rectangular, or substantially circular, in transverse cross section.

10. A hand rail baluster support, having a substantially cylindrical containment portion, an opening in the containment portion for receiving a hand rail baluster, a face plate extending substantially around the opening, and a substantially planar flange extending from the containment portion, the flange being substantially perpendicular with respect to the face plate.

11. A hand rail support according to claim 10, wherein the face plate and the flange each have an aperture or apertures for receiving fixing members.

12. A hand rail support according to claim 10, wherein the face plate extends around and is substantially flush with the opening.

13. A hand rail baluster support, having a pillar, a face plate attached to the pillar, and a substantially planar flange extending from the face plate, the flange being substantially perpendicular with respect to the face plate.

14. A hand rail support according to claim 13, wherein the pillar is substantially cylindrical.

15. A hand rail support according to claim 13, wherein the face plate and the flange each have an aperture or apertures for receiving fixing members.

16. A hand rail support according to claim 13, wherein the pillar is substantially cylindrical and there is an opening leading into the pillar, the face plate being adjacent an end of the pillar which is remote from the opening.

17. In combination, a building construction, a hand rail support secured to the building construction, and a hand rail, the hand rail having at least one baluster and a balustrade, the hand rail support having a containment portion, the containment portion having an opening through which at least part of the baluster passes such that at least a portion of the baluster is secured within the containment portion by a set settable substance, the set settable substance being arranged within the containment portion substantially around at least part of the baluster, a sheet of water impervious material extending from the building construction to the hand rail support, the face plate being substantially flush with an exterior facing surface of the building construction, and the containment portion being substantially within a cavity of the building construction, the hand rail support being arranged such that water is unable to pass immediately around the hand rail support to an area within the building construction to cause damage to the building construction.

18. A combination according to claim 17, wherein the set settable substance is a suitable grout.

19. In combination, a building construction, a hand rail support secured to the building construction, and a hand rail, the hand rail having at least one baluster and a balustrade, the hand rail support having a pillar, the baluster being fitted around the pillar, a sheet of water impervious material extending from the building construction to the baluster, the face plate being against an exterior facing surface of the building construction, and the pillar extending outwards of the building construction from the face plate, the hand rail support being arranged such that water is unable to pass immediately around the hand rail support to an area within the building construction to cause damage to the building construction.

20. A combination according to claim 19, wherein the water impervious material extends to between the baluster and the pillar.

* * * * *